US007942133B2

(12) United States Patent
Alessandri et al.

(10) Patent No.: US 7,942,133 B2
(45) Date of Patent: May 17, 2011

(54) CONTROL METHOD OF AN ELECTRONIC INJECTION FUEL FEEDING SYSTEM

(75) Inventors: Andrea Alessandri, Bologna (IT); Fabrizio Naccarato, Guagnano (IT); Maurizio Fiorentini, Molinella (IT); Massimo Mattioli, Calderara Di Reno (IT)

(73) Assignee: Magneti Marelli S.p.A. (IT)

( * ) Notice: Subject to any disclaimer, the term of this patent is extended or adjusted under 35 U.S.C. 154(b) by 264 days.

(21) Appl. No.: 12/390,722

(22) Filed: Feb. 23, 2009

(65) Prior Publication Data

US 2009/0217910 A1 Sep. 3, 2009

(30) Foreign Application Priority Data

Feb. 29, 2008 (EP) ..... 08425126

(51) Int. Cl.
*F02M 37/08* (2006.01)
*F02M 37/04* (2006.01)

(52) U.S. Cl. ..... 123/497; 123/499

(58) Field of Classification Search ..... 123/497, 123/499, 496, 357, 445, 446, 501; 701/104
See application file for complete search history.

(56) References Cited

U.S. PATENT DOCUMENTS

| | | | | |
|---|---|---|---|---|
| 5,740,783 | A * | 4/1998 | Learman et al. | 123/497 |
| 6,820,596 | B2 * | 11/2004 | Namari et al. | 123/501 |
| 2004/0011335 | A1 * | 1/2004 | Namari et al. | 123/501 |
| 2004/0094128 | A1 * | 5/2004 | Ranaldo et al. | 123/458 |
| 2005/0175481 | A1 | 8/2005 | Harbuck | 417/416 |
| 2008/0245343 | A1 * | 10/2008 | Graf | 123/497 |

FOREIGN PATENT DOCUMENTS

| | | |
|---|---|---|
| DE | 101 62 989 | 10/2003 |
| JP | 58-117351 | 7/1983 |
| JP | 3-179158 | 8/1991 |
| WO | WO 91/18196 | 11/1991 |
| WO | WO 2007/031463 | 3/2007 |

OTHER PUBLICATIONS

European Search Report mailed Sep. 10, 2008 in corresponding European Application No. 08425126.3.

* cited by examiner

*Primary Examiner* — Mahmoud Gimie
(74) *Attorney, Agent, or Firm* — Ostrolenk Faber LLP

(57) ABSTRACT

A control method of an electronic injection fuel feeding system for an internal combustion engine and displaying at least one injector and a non-continuous flow rate fuel pump actuated by a an actuator device; the control method includes the steps of: determining the desired fuel amount which must be injected at each cycle of the internal combustion engine; driving the injector for injecting the desired fuel amount at each cycle of the internal combustion engine; determining an optimal pumping frequency of the actuator device of the fuel pump according to the desired fuel amount which must be injected at each cycle of the internal combustion engine; and actuating the actuator device of the fuel pump at the optimal pumping frequency.

15 Claims, 4 Drawing Sheets

CONTROL METHOD OF AN ELECTRONIC INJECTION FUEL FEEDING SYSTEM

TECHNICAL FIELD

The present invention relates to a control method of an electronic injection fuel feeding system.

The present invention is advantageously applied to a low-powered internal combustion engine for motorcycles, to which explicit reference will be made in the following description without therefore loosing in generality.

BACKGROUND ART

In order to respect the increasingly lower emission restrictions imposed by recent anti-pollution standards, electronic injection feeding instead of traditional carburetor feeding must also be used for low-powered internal combustion engines for motorcycles (also of only 50 cc).

In an electronic injection fuel feeding system for a low-powered internal combustion engine, an electrically operated fuel pump draws the fuel from a tank at atmospheric pressure and feeds the fuel itself to the injector; the fuel pump must have a very low electric power absorption, compatible with the electric power generated by the electric generator when the internal combustion engine is idling.

The amount of fuel which is injected by an injector depends on both the injection time (i.e. on the time interval for which the injector is kept open) and the fuel feeding pressure. Accordingly, when electronic injection feeding is used, the fuel feeding pressure must be guaranteed constant and equal to a predetermined design value.

In the known low-powered internal combustion engines, a constant flow rate and high-efficiency fuel pump (to keep the electric power consumption low) is used associated to a pressure regulator, which keeps the fuel feeding pressure constant and equal to the predetermined design value. Accordingly, the fuel pump always feeds a constant fuel flow rate to the injector regardless of the engine rate and the pressure regulator recirculates the fuel in excess back to the tank to keep the fuel feeding pressure constant and equal to the predetermined design value.

In other words, the fuel pump is dimensioned to feed an amount of fuel exceeding the actual consumption in all conditions of operation, and downstream of the fuel pump the pressure regulator is provided, which keeps the fuel feeding pressure value constant and equal to the predetermined design value by discharging the fuel in excess into a recirculation channel which re-introduces the fuel in excess itself back into the tank. In this case, the fuel pump must be dimensioned to feed an amount of fuel equal to the maximum possible consumption; however, such a condition of maximum possible consumption occurs rather rarely and in all the remaining conditions of operation the amount of fuel fed by the fuel pump is much greater than the real consumption and therefore a considerable amount of such fuel is to be discharged by the pressure regulator into the tank.

It is apparent that the work performed by the fuel pump for pumping the fuel which is later discharged by the pressure regulator is an "unnecessary" work, and therefore the electronic injection feeding system globally displays a very low energy efficiency. Furthermore, the pressure regulator and the recirculation channel connected to the pressure regulator are rather cumbersome and increase the total costs of the electronic injection feeding system.

In order to solve the above-described drawbacks, it has been proposed to use a fuel pump provided with a variable volume pumping chamber; a one-way intake valve; a one-way delivery valve; a mobile piston which integrates the intake valve therein and which is coupled to the pumping chamber to cyclically vary the volume of the pumping chamber itself; and an actuator device which imparts a reciprocating motion on the piston and displays an electromagnetic actuator to actuate the piston during a step of delivering.

JP58117351A discloses a fuel pump driving circuit which is suitable for electric power saving, by turning ON and OFF the fuel pump, and controlling the ON time in correspondence with the required amount.

WO2007031463A1 discloses a method for operating a fuel pump in order to guide fuel from the fuel container of an internal combustion engine, wherein the electric energy, which is in the form of pulses, is periodically guided to the fuel pump and the duration of the pulses is controlled according to the fuel required by the internal combustion engine. The frequency of the pulses is controlled in such a manner that, in the event of low pump capacity of the fuel pump, the frequency is controlled to a higher level than in the even of a high pump capacity.

DISCLOSURE OF INVENTION

It is the object of the present invention to make a control method of an electronic injection fuel feeding system, which control method is easy and cost-effective to implement, allows to very accurately adjust the fuel feeding pressure, and displays a very high energy efficiency (i.e. a low electric energy consumption).

According to the present invention, a control method of an electronic injection fuel feeding system as set forth in the attached claims is provided.

BRIEF DESCRIPTION OF THE DRAWINGS

The present invention will now be described with reference to the accompanying drawings, which disclose a non-limitative embodiment thereof, in which.

PREFERRED EMBODIMENTS OF THE INVENTION

Figure 1:
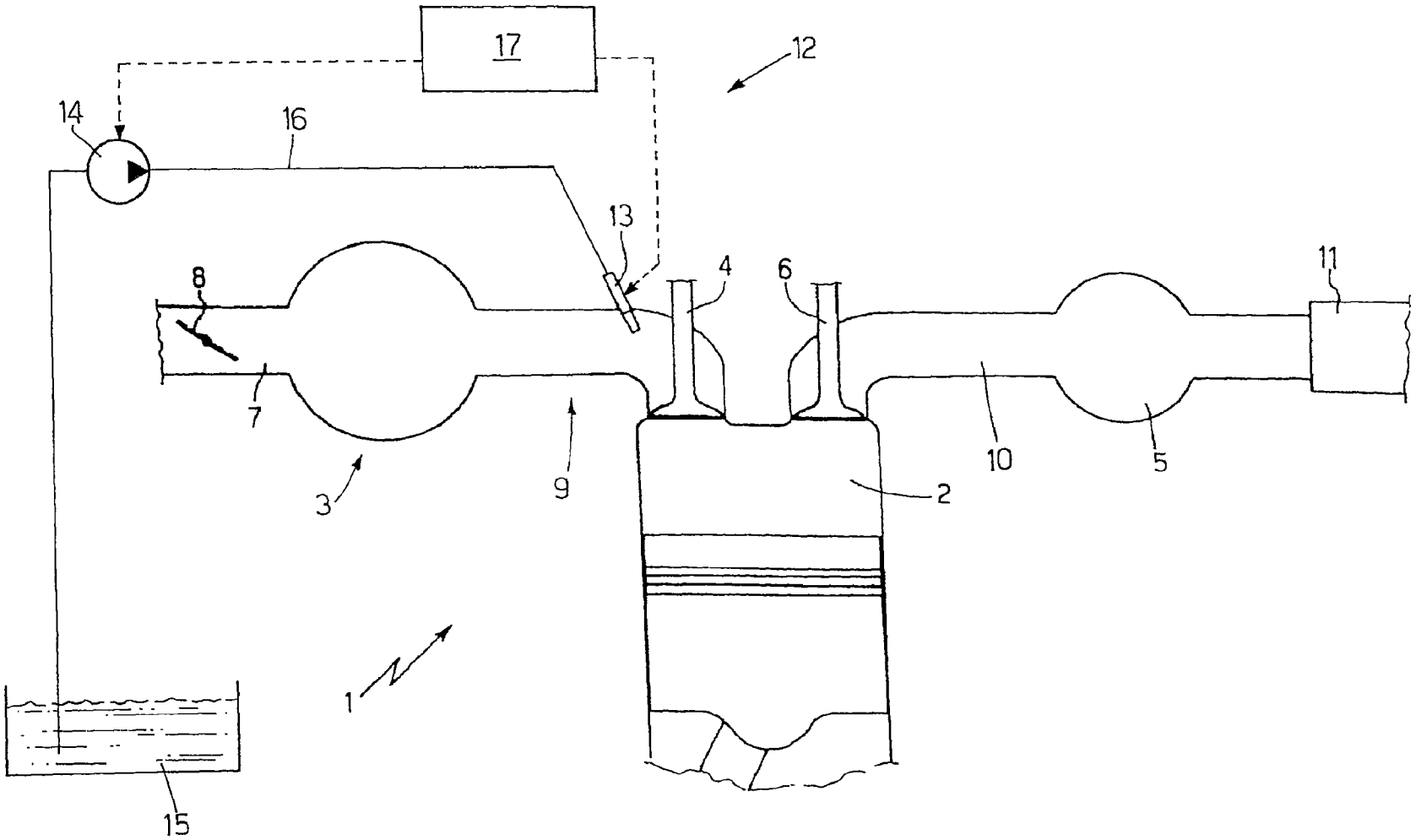
FIG. 1 is a diagrammatic view of an internal combustion engine provided with an electronic injection fuel feeding system which works according to the control method of the present invention.

In FIG. 1, numeral 1 indicates as a whole an internal combustion engine provided with a cylinder 2, which is connected to an intake manifold 3 by means of at least one intake valve 4 and to an exhaust manifold 5 by means of at least one exhaust valve 6.

The intake manifold 3 receives fresh air (i.e. air from the external environment) through a feeding pipe 7 adjusted by a butterfly valve 8 and is connected to the cylinder 2 by means of an intake pipe 9, which is adjusted by the intake valve 4. Similarly, the exhaust manifold 5 is connected to the cylinders 2 by means of an exhaust pipe 10, which is adjusted by the exhaust valve 6; from the exhaust manifold 5 an emission pipe 11 departs, which ends with a muffler (known and not shown) to emit the gases produced by the combustion into the atmosphere.

The fuel (normally gasoline) is fed to the cylinder 2 by means of an electronic injection feeding system 12, which includes an injector 13 arranged close to the intake valve 4 to inject the fuel itself into the intake pipe 9. According to a different embodiment (not shown), the injector 13 is arranged so as to inject the fuel into the cylinder 2. The feeding system 12 further includes a non-continuous flow rate fuel pump 14, which draws the fuel from a tank 15 at atmospheric pressure and feeds the fuel itself to the injector 13. The fuel pump 14 is hydraulically connected to the injector 13 by means of a connection pipe 16, which constitutes an elastic plenum. Preferably, the connection pipe 16 includes at least one portion consisting of a tube made of elastic material (rubber or the like) which defines the elastic plenum; alternatively, the connection pipe 16 could be entirely made of rigid material and could include an independent elastic plenum.

An electronic control unit 17 adjusts the operation of the feeding system 12 and specifically drives the injector 13 for cyclically injecting the fuel during the steps of taking in by the piston and drives the fuel pump 14 for feeding the fuel to the injector 13 at a constant, predetermined pressure.

Figure 2:
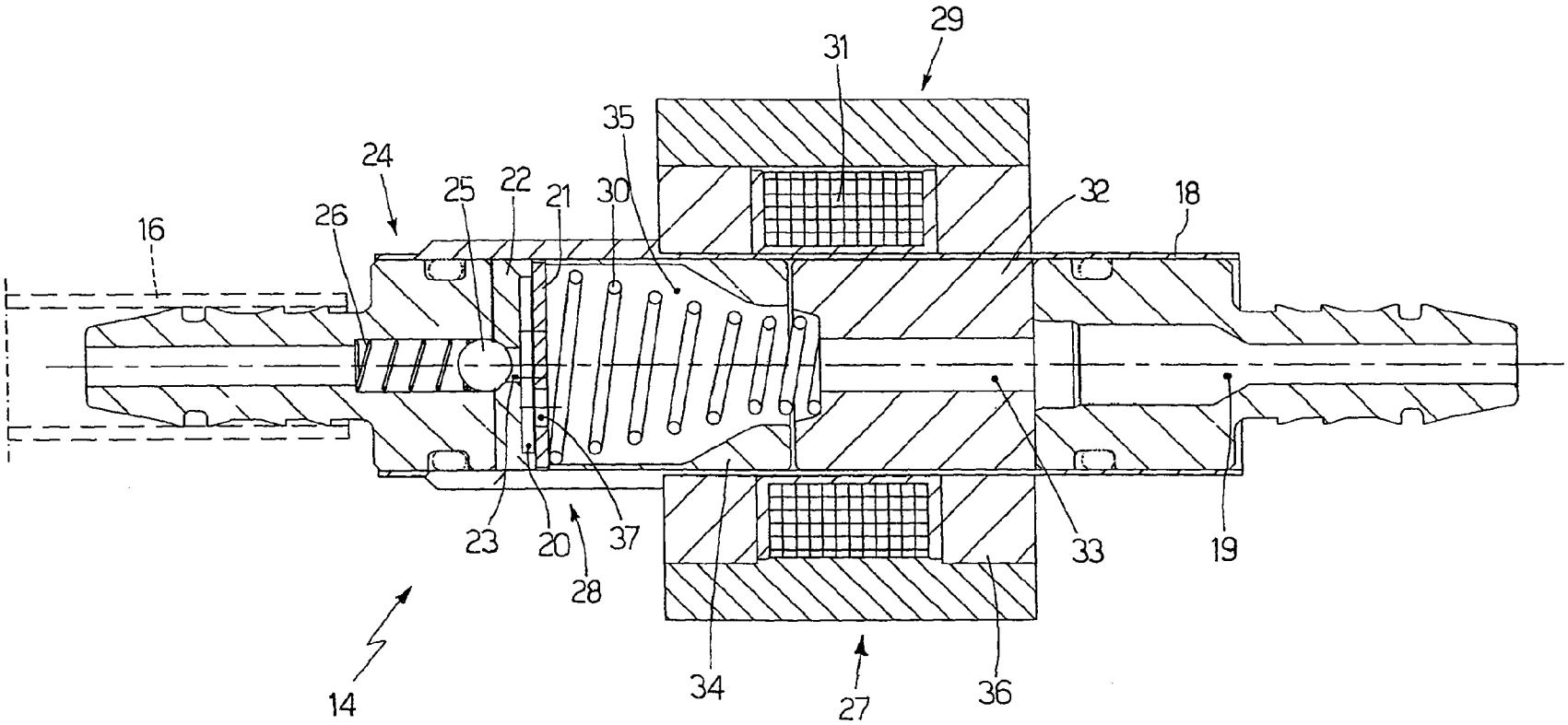
FIG. 2 is a section view with parts removed for clarity of a fuel pump of the feeding system in FIG. 1.

As shown in FIG. 2, the fuel pump 14 includes a cylindrical tubular housing body 18, displaying a central feeding channel 19, which is connected on one side to the fuel tank 15 and on the opposite side to the injector 13 by means of the connection pipe 16.

Inside the housing body 18 and along the feeding channel 19 a variable volume pumping chamber 20 is defined, which displays a cylindrical shape, is laterally delimited by the housing body 18, and is axially delimited by a mobile piston 21, and by a fixed closing disc 22 displaying a through delivery hole 23 engaged by a one-way delivery valve 24 which adjusts the release of fuel from the pumping chamber 20. Preferably, the delivery valve 24 is a ball valve and includes a ball shutter 25 which is pushed against a mouth of the delivery hole 23 by a valve spring 26.

The piston 21 is actuated by an actuator device 27, which in use imparts a reciprocating movement to the piston 21 itself to cyclically vary the volume of the pumping chamber 20. The piston 21 integrates a one-way intake valve 28 therein, which adjusts the fuel feeding to the pumping chamber 20.

The actuator device 27 includes an electromagnetic actuator 29 for actuating the piston 21 during a step of taking in and a spring 30 for actuating the piston 21 during a step of delivering. In other words, during the step of taking in, the electromagnetic actuator 29 is energized to displace the piston 21 in a first direction so as to increase the volume of the pumping chamber 20 and against the bias exerted by the spring 30; at the end of the step of taking in, the electromagnetic actuator 29 is de-energized and the piston 21 is displaced in a second direction opposite to the first direction so as to reduce the volume of the pumping chamber 20 by the elastic bias exerted by the spring 30.

According to a preferred embodiment, the spring 30 is dimensioned so that the preloading bias exerted by the spring 30 on the piston 21 is equal to the active area of the piston 21 (i.e. to the circular surface of the piston 21 which delimits the pumping chamber 20) multiplied by the desired fuel feeding pressure. In this manner, the spring 30 is able to push the fuel out from the pumping chamber 21 through the delivery valve 24 and towards the connection pipe 16 leading to the injector 13 only if the fuel pressure inside the connection pipe 16 is lower than the desired fuel feeding pressure; otherwise the system is balanced, i.e. the bias exerted by the spring 30 on the fuel present in the pumping chamber 20 is equal to the opposite bias exerted by the fuel present in the connection pipe 16, therefore the delivery valve 24 does not open and the piston 21 remains still. It is important to point out that the contribution of the valve spring 26 has been compensated in the dimensioning of the spring 30 proposed above.

The electromagnetic actuator 29 includes a coil 31, a fixed magnetic pole 32, which is arranged inside the housing body 18 and displays a central hole 33 to allow the flow of fuel along the feeding channel 19, and a mobile anchor 34, which is arranged inside the housing body 18, displays a central hole 35 to allow the fuel flow along the feeding channel 19, is rigidly connected to the piston 21, and is adapted to be magnetically attracted by the magnetic pole 32 when the coil 31 is energized.

According to a preferred embodiment, the coil 31 is arranged outside about the housing body 18 and is therefore insulated from the fuel (this solution is commercially known as "dry coil"); in this manner, the insulation of the coil 31 does not need to be fluid-tight and does not need to withstand the corrosion generated by the fuel and therefore it may be much simpler and more inexpensive with respect to an equivalent insulation intended to come in contact with the fuel.

Furthermore, the electromagnetic actuator 29 includes a tubular magnetic armature 36, which is arranged outside the housing body 18 and includes a seat to house the coil 31 therein.

Preferably, the spring 30 is arranged inside the central hole 35 of the mobile anchor 34 and is compressed between the fixed magnetic pole 32 and the piston 21. Furthermore, the spring 30 preferably displays a conical shape having the larger base at the piston 21 to simply the assembly of the spring 30 itself.

The piston 21 consists of a thin disc and is provided with a plurality of through feeding holes 37; the intake valve 28 includes a deformable foil (not shown in detail) fixed to the piston 21 at a peripheral edge thereof and provided with a series of petals (not shown in detail), each of which is coupled to a corresponding feeding hole 37. Normally, each petal of the foil is arranged in a closing position of the feeding hole 37 and is mobile, during the outward stroke of the piston 21, from the closing position to an opening position of the feeding hole 37 itself to allow the gasoline to enter into the pumping chamber 20.

The operation of the fuel feeding system 21 is described below, starting from a rest condition in which the internal combustion engine 1 is off and electrically not supplied, i.e. from a rest condition in which an ignition key (not shown) is arranged in an off position. In this condition, the fuel pump 14 (i.e. the actuator device 27 of the fuel pump 14) is also not electrically supplied.

When the internal combustion engine 1 is electrically supplied (i.e. when the ignition key is arranged in an on position), the fuel pump 14 (i.e. the actuator device 27 of the fuel pump 14) is also electrically supplied. When the fuel pump 14 (i.e. the actuator device 27 of the fuel pump 14) is electrically supplied, the electronic control unit 17 actuates the actuator device 27 of the fuel pump 14 at the maximum possible pumping frequency $F_{pump}$ (indicatively approximately 60 Hz) and for a predetermined number of times in order to pressurize the connection pipe 16. In this manner, as soon as the fuel pump 14 is electrically supplied, the connection pipe 16 is pressurized in order to establish the best possible conditions for subsequently starting the internal combustion engine 1. It is worth observing that the number of times which the actuator device 27 of the fuel pump 14 is actuated for depends on the volume of the connection pipe 16, on the elasticity of the connection pipe 16, and on the volume of the pumping chamber 20; indicatively, the number of times which the actuator device 27 of the fuel pump 14 is operated for is slightly higher than the ratio between the volume of the connection pipe 16 and the volume of the pumping chamber 20. Once the connection pipe 16 has been pressurized as described above and until the internal combustion engine 1 is started (or, alternatively, until the internal combustion engine 1 is electrically switched off), the electronic control unit 17 keeps the connection pipe 16 pressurized by actuating the actuator device 27 of the fuel pump 14 at a predetermined maintenance frequency (indicatively approximately 1 Hz) to compensate for the inevitable seeping losses.

It is worth observing that the above-described mode of pressurizing the connection pipe 16 and then keeping it pressurized is repeated whenever the fuel pump 14 (i.e. the actuator device 27 of the fuel pump 14) is electrically supplied; therefore, the above-described mode of pressurizing the connection pipe 16 and then keeping it pressurized is repeated both when the internal combustion engine 1 is electrically supplied for the first time after a stop, and when the internal combustion engine 1 is electrically supplied again, e.g. after a stop by means of an emergency switch.

When the internal combustion engine 1 is started, the electronic control unit 17 cyclically determines the desired fuel amount $M_{fuel}$ which must be injected at each cycle of the internal combustion engine 1 and thus drives the injector 3 to inject the desired fuel amount $M_{fuel}$ at each cycle of the internal combustion engine 1. In other words, the electronic control unit 17 in use drives the injector 3 with an injection frequency $F_{inj}$ which is directly proportional to the rotation speed of the internal combustion engine 1, in particular it is equal to half the rotation frequency of the internal combustion engine 1 (note that the injector 3 injects once every two revolutions of the internal combustion engine 1), and at every injection the electronic control unit 17 drives the injector 3 to inject the desired fuel amount $M_{fuel}$.

Furthermore, the electronic control unit 17 cyclically determines an optimal pumping frequency $F_{pump}$ of the actuator device 27 of the fuel pump 14 according to the desired fuel amount $M_{fuel}$ which must be injected at each cycle of the internal combustion engine 1, and thus actuates the actuator device 27 of the fuel pump 14 at the optimal pumping frequency $F_{pump}$. Obviously, the greater is the desired fuel amount $M_{fuel}$ to be injected at each cycle of the internal combustion engine 1 (i.e. the higher is the average flow rate requested to the fuel pump 14), the higher is the optimal pumping frequency $F_{pump}$ of the actuator device 27 of the fuel pump 14.

According to the present invention, during a design phase, are identified a lower threshold value Th1 (approximately equal to 10% of the maximum fuel amount which can be injected at every cycle of the internal combustion engine 1) and a higher threshold value Th2 (approximately equal to 50% of the maximum fuel amount which can be injected at every cycle of the internal combustion engine 1). Once the electronic control unit 17 has determined the desired fuel amount $M_{fuel}$ which has to be injected at every cycle of the internal combustion engine 1, the electronic control unit 17 compares the desired fuel amount $M_{fuel}$ with the two threshold values Th1 and Th2 to verify whether the desired fuel amount $M_{fuel}$ is lower than the lower threshold value Th1, whether it is comprised between the two threshold values Th1 and Th2, or whether it is higher than the higher threshold value Th2.

When the desired fuel amount $M_{fuel}$ is lower than the lower threshold value Th1, the electronic control unit 17 assigns to the optimal pumping frequency $F_{pump}$ a value which is independent from the injection frequency $F_{inj}$; then, when the desired fuel amount $M_{fuel}$ is lower than the lower threshold value Th1, the electronic control unit 17 drives the fuel pump 14 in an asynchronous (i.e. non synchronized) manner with respect to the driving of the injector 3. According to a preferred embodiment, when the desired fuel amount $M_{fuel}$ is lower than the lower threshold value Th1, the electronic control unit 17 assigns to the optimal pumping frequency $F_{pump}$ a constant value which is independent from the actual value of the desired fuel amount $M_{fuel}$ and is determined during a design and setting up phase; in other words, when the desired fuel amount $M_{fuel}$ is lower than the lower threshold value Th1, the optimal pumping frequency $F_{pump}$ assumes a constant value without taking into account the actual value of the desired fuel amount $M_{fuel}$ (which anyway has to be lower than the lower threshold value Th1). It is important to note that when the desired fuel amount $M_{fuel}$ is lower than the lower threshold value Th1, the optimal pumping frequency $F_{pump}$ is always lower than the injection frequency $F_{inj}$.

When the desired fuel amount $M_{fuel}$ is comprised between the two threshold values Th1 and Th2, the electronic control unit 17 assigns to the optimal pumping frequency $F_{pump}$ the same value of the injection frequency $F_{inj}$, i.e. the optimal pumping frequency $F_{pump}$ is identical to the injection frequency $F_{inj}$; then, when the desired fuel amount $M_{fuel}$ is comprised between the two threshold values Th1 and Th2, the electronic control unit 17 drives the fuel pump 14 in a synchronous (i.e. synchronized) manner with respect to the driving of the injector 3. As a consequence, each actuation of the injector 3 corresponds to an actuation of the fuel pump 14 and vice versa.

When the desired fuel amount $M_{fuel}$ is higher than the higher threshold value Th2, the electronic control unit 17 assigns to the optimal pumping frequency $F_{pump}$ a value which is independent from the injection frequency $F_{inj}$; then, when the desired fuel amount $M_{fuel}$ is higher than the higher threshold value Th2, the electronic control unit 17 drives the fuel pump 14 in an asynchronous (i.e. non synchronized) manner with respect to the driving of the injector 3. According to a preferred embodiment, when the desired fuel amount $M_{fuel}$ is higher than the higher threshold value Th2, the electronic control unit 17 assigns to the optimal pumping frequency $F_{pump}$ a variable value which depends on the actual value of the desired fuel amount $M_{fuel}$ (namely as much higher as greater is the desired fuel amount $M_{fuel}$). Preferably, when the desired fuel amount $M_{fuel}$ is higher than the higher threshold value Th2, the optimal pumping frequency $F_{pump}$ is provided by a map which is stored in a memory of the electronic control unit 17 and determined experimentally. It is important to note that, when the desired fuel amount $M_{fuel}$ is higher than the higher threshold value Th2, the optimal pumping frequency $F_{pump}$ is always higher than the injection frequency $F_{inj}$.

Preferably, the electronic control unit 17 phases the actuation of the actuator device 27 of the fuel pump 14 with the driving of the injector 3 so that, to the greatest possible extent, the pumping stroke of the fuel pump 14 occurs when the injector 3 injects the fuel. Obviously, it is possible to make the pumping stroke of the fuel pump 14 always occur when the injector 3 injects the fuel only when the optimal pumping frequency $F_{pump}$ of the actuator device 27 of the fuel pump 14 is identical to the injection frequency $F_{inj}$ (i.e. when the desired fuel amount $M_{fuel}$ is comprised between the two threshold values Th1 and Th2); in all other conditions, only in some moments is it possible to make the pumping stroke of the fuel pump 14 occur when the injector 3 injects the fuel, because in the same time interval the number of pumping strokes of the fuel pump 14 is different from the number of injections operated by the injector 3.

When the desired fuel amount $M_{fuel}$ is lower than the lower threshold value Th1, the optimal pumping frequency $F_{pump}$ is always lower than the injection frequency $F_{inj}$ and, therefore, the pumping of the fuel pump 14 can always take place when the injector 3 injects the fuel, but not vice versa, since, within the time unit, the number of injections of the injector 3 is higher than the number of pumpings of the fuel pump 14.

When the desired fuel amount $M_{fuel}$ is comprised between the two threshold values Th1 and Th2, the optimal pumping frequency $F_{pump}$ is identical to the injection frequency $F_{inj}$ and, therefore, the pumping of the fuel pump 14 can always take place when the injector 3 injects the fuel, and vice versa, since, within the time unit, the number of injections of the injector 3 is identical to the number of pumpings of the fuel pump 14.

When the desired fuel amount $M_{fuel}$ is higher than the higher threshold value Th2, the optimal pumping frequency $F_{pump}$ is always higher than the injection frequency $F_{inj}$ and, therefore, only a part of the pumpings of the fuel pump 14 takes place when the injector 3 injects the fuel, while the rest of the pumpings of the fuel pump 14 takes place when the injector 3 does not inject the fuel, since, within the time unit, the number of injections of the injector 3 is lower than the number of pumpings of the fuel pump 14.

In order to phase the actuation of the actuator device 27 of the fuel pump 14 with the driving of the injector 3, the electronic control unit 17 determines the start of the fuel injection and thus determines the start of the actuation of the actuator device 27 of the fuel pump 14 by applying a predetermined advance with respect to the start of the fuel injection.

According to a preferred embodiment, the electronic control unit 17 determines the actuation of the actuator device 27 of the fuel pump 14 not only according to the desired fuel amount $M_{fuel}$ which must be injected at each cycle of the internal combustion engine 1, but also according to a battery voltage (i.e. to an electric power voltage of the actuator device 27 of the fuel pump 14). Specifically, the lower is the battery voltage, the higher is the optimal actuation time of the actuator device 27 of the fuel pump 14. In other words, when the tension of the battery varies, the times of ON/OFF actuation of both the energizing control and the recirculation control are modified in order to take into account the variation of the electric actuation capacity.

The above-described control method of the fuel pump 14 of the above-described feeding system 12 displays many advantages, because it allows to very accurately adjust the fuel feeding pressure by constantly ensuring the ideal fuel injection conditions while displaying a very high energy efficiency (i.e. a low electric energy consumption).

Figure 3:
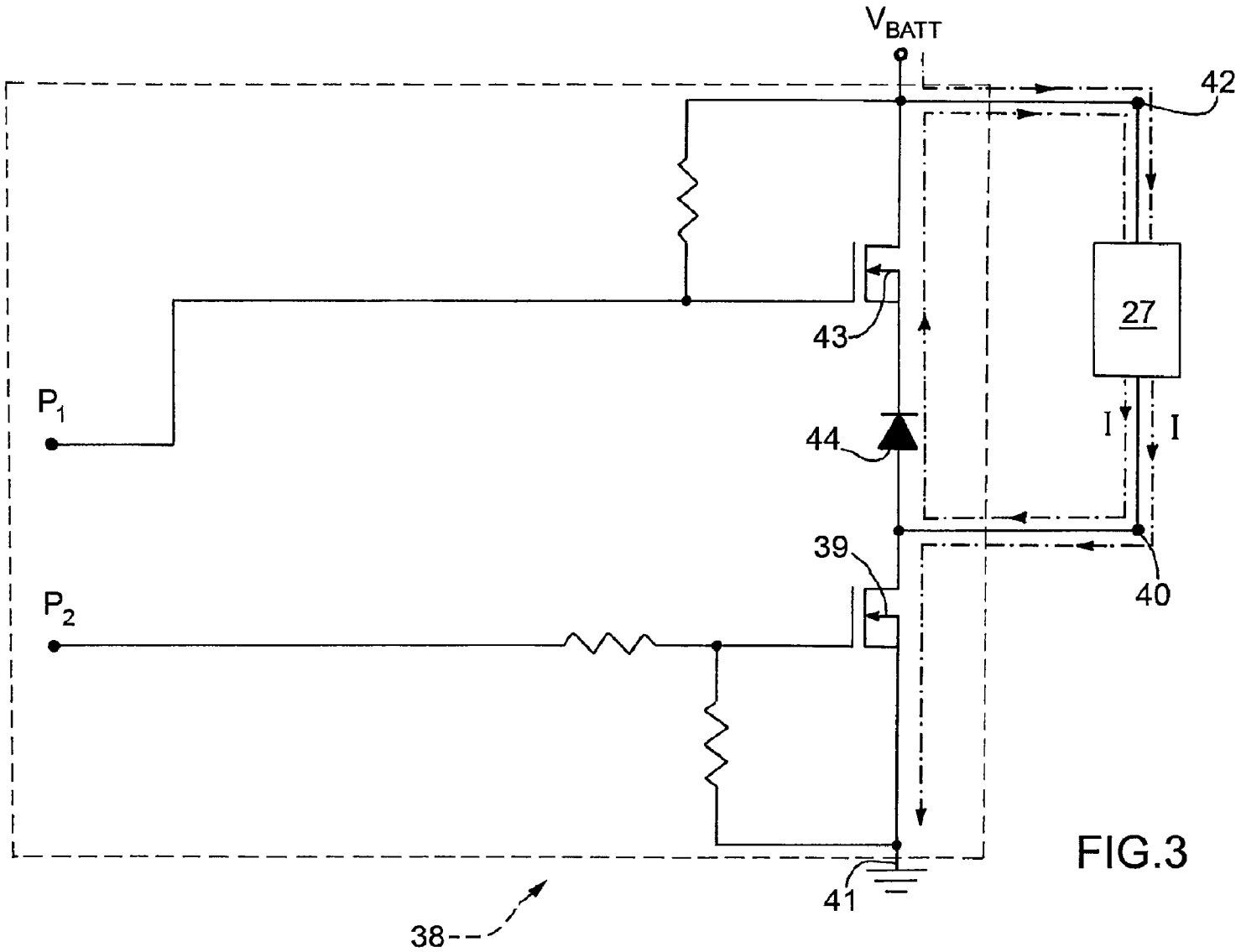
FIG. 3 is a wiring diagram of a driving device of the fuel pump in FIG. 2.

As shown in FIG. 3, the electronic control unit 17 includes a driving device 38 which supplies electricity to the actuator device 27 of the fuel pump 14, or better to the coil 31 of the electromagnetic actuator 29 of the actuator device 27 of the fuel pump 14. The driving device 38 includes an energizing transistor 39, which connects a first terminal 40 of the actuator device 27 to an electric ground 41 (or, alternatively, to a power supply voltage Vbatt); the other terminal 42 of the actuator device 27 is electrically connected to the power supply voltage Vbatt (or, alternatively, to the electric ground 41). Furthermore, the driving device 38 includes a recirculation transistor 43, which connects in short-circuit the two terminals 40 and 42 of the actuator device 27, and a recirculation diode 44, which is arranged in series to the recirculation transistor 43 to avoid a possible short-circuit between the electric ground 41 and the power supply voltage Vbatt when both transistors 39 and 43 are closed.

Figure 4:
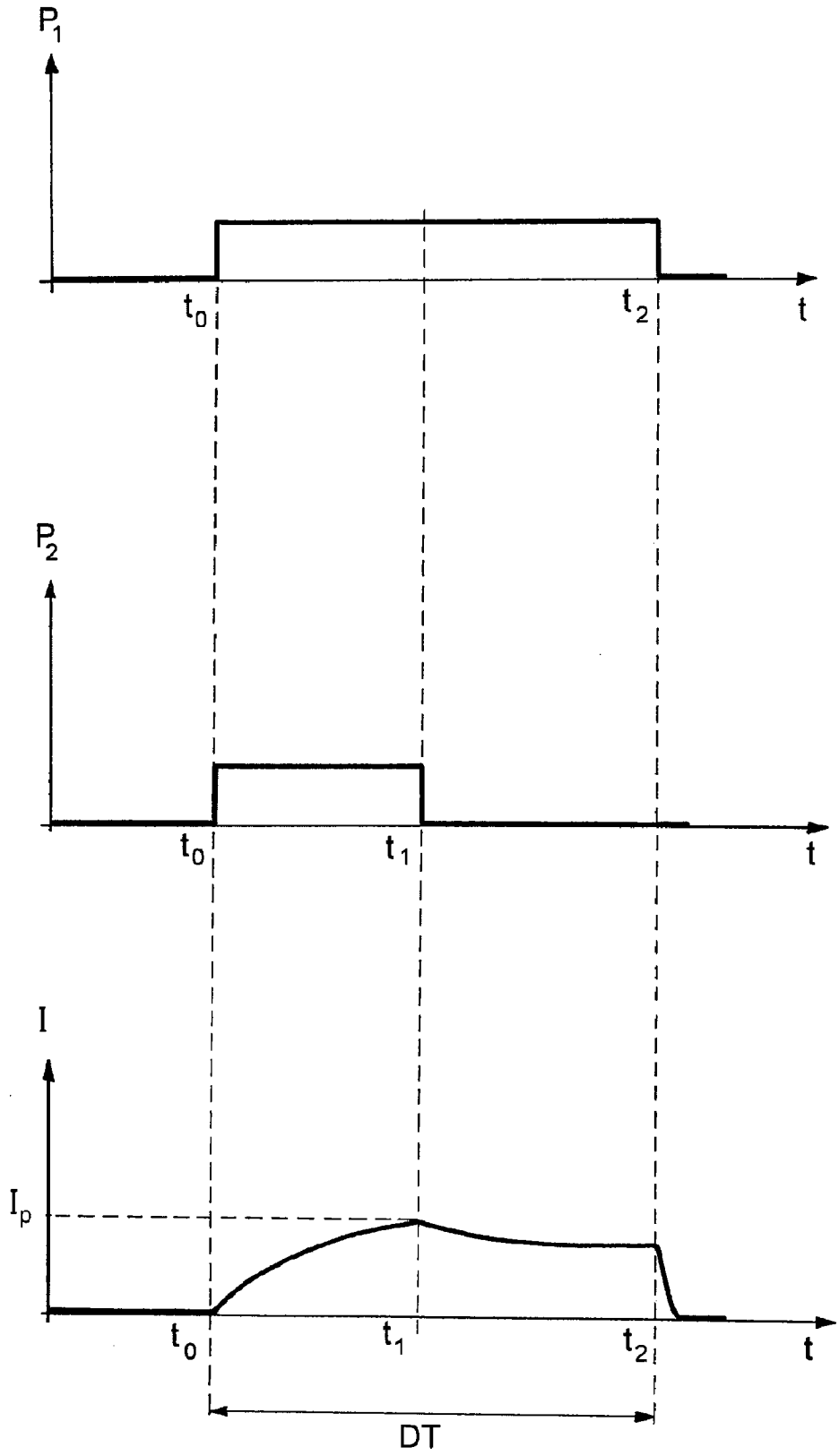
FIG. 4 is a chart which diagrammatically shows the time evolution of some electric magnitudes of the driving device in FIG. 3.

With reference to FIG. 4, the operating mode of the driving device 38 for actuating the actuator device 27 of the fuel pump 14 is described below starting from an instant $t_0$ and for a time interval $\Delta T$ (i.e. from the instant $t_0$ until a later instant $t_2$).

In the instant $t_0$, the electronic control unit 17 closes the energizing transistor 39 by acting on the control $P_1$ and closes the recirculation transistor 43 by acting on the control $P_2$. In this manner, the terminal 42 of the actuator device 27 is connected to the power supply voltage Vbatt and the terminal 40 of the actuator device 27 is connected to the electric ground 41; accordingly, the current I through the actuator device 27 increases exponentially until it reaches a peak value IP at the instant $t_1$. When the current I through the actuator device 27 reaches the peak value $I_p$ at the instant $t_1$, the electronic control unit 17 opens the energizing transistor 39 by acting on the control $P_1$. In this manner, the terminals 40 and 42 of the actuator device 27 are reciprocally short-circuit connected through the recirculation transistor 43 and through the recirculation diode 44; therefore, the current I through the actuator device 27 decreases exponentially from the peak value $I_p$ reached at the instant $t_1$.

At the instant t2, i.e. at the end of the time interval $\Delta T$, the electronic control unit 17 opens the recirculation transistor 43. In this manner, the terminals 40 and 42 of the actuator device 27 are reciprocally electrically insulated; therefore, the current I through the actuator device 27 rapidly drops to zero.

Preferably, the energizing transistor 39 and the recirculation transistor 43 are closed together at the instant t0, because the time management of the controls $P_1$ and $P_2$ is easier by operating in this manner. Alternatively, the recirculation transistor 43 could be closed at any instant between $t_0$ and $t_1$. It is worth observing that in virtue of the presence of the recirculation diode 44, no short-circuit occurs between the electric ground 41 and power supply voltage Vbatt when both the transistors 39 and 43 are closed.

In FIG. 3, an externally arranged dashed-and-dotted line indicates the path of the current I through the actuator device 27 when the energizing transistor 39 is closed and an internally arranged dashed-and-dotted line indicates the path of the current I through the actuator device 27 when the energizing transistor 39 is open.

The above-described driving device 38 is particularly simple and cost-effective, because it does not use any type of feedback control and therefore does not require the measurement of the intensity of the current I through the actuator device 27. It is worth observing that the driving device 38, although not using any type of feedback control, however allows an accurate control of the current I through the actuator device 27 and thus allows an optimal control of the pumping stroke of the fuel pump 14.

Furthermore, the above-described driving device 38 also displays a high energy efficiency (i.e. a low current consumption), because the battery is required to supply electric energy only between the instants $t_0$ and $t_1$ when the energizing transistor 39 is closed; on the contrary, between the instants $t_1$ and $t_2$ when the energizing transistor 39 is opens only the energy stored in the inductance of the actuator device 27 is exploited without requiring any supply of electric energy from the battery.

The invention claimed is:

1. A control method of an electronic injection fuel feeding system (12) for an internal combustion engine (1) and including at least one injector (13) and a non-continuous flow rate fuel pump (14) actuated by a an actuator device (27); the control method including the steps of:

determining the desired fuel amount ($M_{fuel}$) which must be injected at each cycle of the internal combustion engine (1);

driving the injector (3) for injecting the desired fuel amount ($M_{fuel}$) at each cycle of the internal combustion engine (1) and at an injection frequency ($F_{inj}$) depending on the rotation speed of the internal combustion engine (1);

determining an optimal pumping frequency ($F_{pump}$) of the actuator device (27) of the fuel pump (14) according to the desired fuel amount ($M_{fuel}$) which must be injected at each cycle of the internal combustion engine (1); and actuating the actuator device (27) of the fuel pump (14) at the optimal pumping frequency ($F_{pump}$);

the control method is characterized in that it includes the further steps of:

determining in a design phase, a lower threshold value (Th1) and a higher threshold value (Th2);

comparing the desired fuel amount ($M_{fuel}$) with the two threshold values (Th1, Th2);

assigning to the optimal pumping frequency ($F_{pump}$) a value which is independent from the injection frequency ($F_{inj}$) when the desired fuel amount ($M_{fuel}$) is lower than the lower threshold value (Th1) or when the desired fuel amount ($M_{fuel}$) is higher than the higher threshold value (Th2) in order to drive the fuel pump (14) in an asynchronous manner with respect to the driving of the injector (3); and assigning to the optimal pumping frequency ($F_{pump}$) the same value of the injection frequency ($F_{inj}$) when the desired fuel amount ($M_{fuel}$) is comprised between the two threshold values (Th1, Th2) in order to drive the fuel pump (14) in a synchronous manner with respect to the driving of the injector (3).

2. Control method according to claim 1, wherein the lower threshold value (Th1) is approximately equal to 10% of the maximum fuel amount which can be injected at every cycle of the internal combustion engine (1), and the higher threshold value (Th2) is approximately equal to 50% of the maximum fuel amount which can be injected at every cycle of the internal combustion engine (1).

3. Control method according to claim 1 and comprising the further step of assigning to the optimal pumping frequency ($F_{pump}$) a constant value which is independent from the actual value of the desired fuel amount ($M_{fuel}$) when the desired fuel amount ($M_{fuel}$) is lower than the lower threshold value (Th1).

4. Control method according to claim 1 and comprising the further step of assigning to the optimal pumping frequency ($F_{pump}$) a variable value which depends on the desired fuel amount ($M_{fuel}$) when the desired fuel amount ($M_{fuel}$) is higher than the higher threshold value (Th2).

5. Control method according to claim 1, wherein the optimal pumping frequency ($F_{pump}$) is always lower than the injection frequency ($F_{inj}$) when the desired fuel amount ($M_{fuel}$) is lower than the lower threshold value (Th1).

6. Control method according to claim 1, wherein the optimal pumping frequency ($F_{pump}$) is always higher than the injection frequency ($F_{inj}$) when the desired fuel amount ($M_{fuel}$) is higher than the higher threshold value (Th2).

7. A control method according to claim 1 and including the further step of phasing the actuation of the actuator device (27) of the fuel pump (14) with the driving of the injector (3) so that, to the greatest possible extent, the pumping stroke of the fuel pump (14) occurs when the injector (3) injects the fuel.

8. A control method according to claim 7 and including the further steps of:

determining the start of the fuel injection; and determining the start of the actuation of the actuating device (27) of the fuel pump (14) by applying a predetermined advance with respect to the start of the fuel injection.

9. Control method according to claim 7 and comprising the further steps of:

making the pumping of the fuel pump 14 take place when the injector 3 injects the fuel if the desired fuel amount ($M_{fuel}$) is comprised between the two threshold values (Th1, Th2) and when the desired fuel amount ($M_{fuel}$) is lower than the lower threshold value (Th1); and making part of the pumpings of the fuel pump 14 take place when the injector 3 injects the fuel if the desired fuel amount ($M_{fuel}$) is higher than the higher threshold value (Th2).

10. A control method according to claim 1 and including the further step of varying the actuation of the actuator device (27) of the fuel pump (14) according to a battery voltage.

11. A control method according to claim 1, wherein the feeding system (12) includes a connection pipe (16), which hydraulically connects the fuel pump (14) to the injector (13); the control method includes the further step of actuating the actuator device (27) of the fuel pump (14) at the maximum possible pumping frequency ($F_{pump}$) and for a predetermined number of times for pressurizing the connection pipe (16) when the fuel pump (14) is electrically supplied.

12. A control method according to claim 11 and including the further step of actuating the actuator device (27) of the fuel pump (14) at a predetermined maintenance frequency immediately after the step of actuating at the maximum possible pumping frequency ($F_{pump}$) and until the internal combustion engine (1) is started.

13. A control method according to claim 1, wherein the feeding system (12) includes a driving device (38) which supplies electric power to the actuator device (27) of the fuel pump (14); the driving device (38) includes:

an energizing transistor (39), which connects a first terminal (40) of the actuator device (27) to an electric ground (41)/power supply voltage (Vbatt);

an electric connection, which connects a second terminal (42) of the actuator device (27) to a power supply voltage (Vbatt)/electric ground (41);

a recirculation transistor (43), which short-circuit connects the two terminals (40, 42) of the actuator device (27); and a recirculation diode (44), which is arranged in series with the recirculation transistor (43) to avoid a possible short-circuit between electric ground (41) and power supply voltage (Vbatt).

14. A control method according to claim 13, wherein the step of actuating the actuator device (27) of the fuel pump (14) includes the further steps of:

closing the energizing transistor (39) so that the current through the actuator device (27) increases from zero to a peak value ($I_p$);

closing the recirculation transistor (43);

opening the energizing transistor (39) so that the current through the actuator device (27) decreases slowly from the peak value ($I_p$); and opening the recirculation transistor (43) to make the current drop rapidly to zero through the actuator device (27).

15. A control method according to claim 1, wherein the fuel pump (14) includes:

a variable volume pumping chamber (20);

a one-way intake valve (28);

a one-way delivery valve (24); and a mobile piston (21) which is coupled to the pumping chamber (20) to cyclically vary the volume of the pumping chamber (2) itself and integrates the intake valve (28) therein;

the actuator device (27) imparts on the piston (21) a reciprocating motion and includes an electromagnetic actuator (29) for actuating the piston (21) during a step of taking in; and a spring (30) for actuating the piston (21) during a step of delivering;

the spring (30) is dimensioned so that the preloading bias exerted by the spring (30) on the piston (21) is equal to the active area of the piston (21) multiplied by the desired fuel feeding pressure.

* * * * *